US009969095B2

(12) United States Patent
Koch

(10) Patent No.: US 9,969,095 B2
(45) Date of Patent: May 15, 2018

(54) SLICING MACHINE WITH REMOVABLE DEPOSITION PLATE

(71) Applicant: Bizerba GmbH & Co. KG, Balingen (DE)

(72) Inventor: Nikolaus Koch, Geislingen (DE)

(73) Assignee: BIZERBA SE & CO. KG, Balingen (DE)

( * ) Notice: Subject to any disclaimer, the term of this patent is extended or adjusted under 35 U.S.C. 154(b) by 135 days.

(21) Appl. No.: 14/854,139

(22) Filed: Sep. 15, 2015

(65) Prior Publication Data

US 2016/0082613 A1 Mar. 24, 2016

(30) Foreign Application Priority Data

Sep. 18, 2014 (DE) ..... 10 2014 113 505

(51) Int. Cl.
*B26D 1/15* (2006.01)
*B26D 1/153* (2006.01)
(Continued)

(52) U.S. Cl.
CPC ..... *B26D 1/15* (2013.01); *B26D 7/00* (2013.01); *B26D 7/0616* (2013.01); *B26D 7/30* (2013.01);
(Continued)

(58) Field of Classification Search
CPC . B26D 1/15; B26D 1/153; B26D 7/00; B26D 7/30; B26D 7/32; B26D 7/0616; B26D 7/225; B26D 2210/02; A22C 17/0033; A22C 17/0093; G01G 19/52; Y10T 83/182; Y10T 83/2033; Y10T 83/222; Y10T 83/242; Y10T 83/6499; Y10T 83/6508; Y10T 83/6515; Y10T 83/6516; Y10T 83/6536
(Continued)

(56) References Cited

U.S. PATENT DOCUMENTS 2,355,487 A * 8/1944 van Berkel ..... B26D 1/153 83/717
2,479,182 A 8/1949 Peters
(Continued)

FOREIGN PATENT DOCUMENTS

CH 497248 A 10/1970
DE 722844 C 7/1942
(Continued)

*Primary Examiner* — Clark F Dexter
(74) *Attorney, Agent, or Firm* — Leydig, Voit & Mayer, Ltd.

(57) ABSTRACT

A slicing machine for cutting slices from lengths of food is provided. The slicing machine includes a machine housing, which retains a drive motor and a rotating blade driven by the drive motor. The machine housing includes a deposition region which is arranged in the region of the blade and has a deposition plate for holding slices that have been cut off. The deposition plate has a rotary shaft and can be rotated from a horizontal position into a vertical position. The deposition plate is rigidly connected to the machine housing or to an attachment part of the machine housing when in the horizontal position, and the deposition plate is removable from the machine housing or from the attachment part of the machine housing when in the vertical position.

16 Claims, 4 Drawing Sheets

(51) Int. Cl.

| | |
|---|---|
| ***B26D 7/06*** | (2006.01) |
| ***B26D 7/30*** | (2006.01) |
| ***B26D 7/00*** | (2006.01) |
| ***B26D 7/32*** | (2006.01) |

(52) U.S. Cl.
CPC ..... *B26D 7/32* (2013.01); *B26D 1/153* (2013.01); *B26D 2210/02* (2013.01); *Y10S 83/932* (2013.01); *Y10T 83/182* (2015.04); *Y10T 83/2033* (2015.04); *Y10T 83/222* (2015.04); *Y10T 83/6536* (2015.04)

(58) Field of Classification Search
USPC ..... 83/77, 84, 167, 168, 707, 713, 717, 718, 83/730, 932
See application file for complete search history.

(56) References Cited

U.S. PATENT DOCUMENTS

| | | | | |
|---|---|---|---|---|
| 2,749,954 | A * | 6/1956 | Green et al. | B26D 1/143 16/235 |
| 4,763,738 | A | 8/1988 | Kuchler | |
| 9,108,330 | B2 * | 8/2015 | Koch | B26D 7/00 |
| 2013/0025427 | A1 * | 1/2013 | Koch | B26D 7/0616 83/435.11 |

FOREIGN PATENT DOCUMENTS

| | | | | |
|---|---|---|---|---|
| DE | 7129722 | U | 11/1971 | |
| DE | 8807446 | U1 | 12/1988 | |
| DE | 4403185 | C1 | 8/1995 | |
| DE | 10 2008 018 173 | A1 * | 10/2009 | B26D 7/32 |
| DE | 1 0 2008 026 982 | A1 * | 12/2009 | B26D 7/32 |
| DE | 10 2009 019 430 | A1 * | 11/2010 | A22C 17/0033 |
| EP | 0216754 | B1 | 4/1987 | |
| EP | 1 637 296 | A1 * | 3/2006 | B26D 7/30 |
| EP | 2 266 765 | * | 12/2010 | B26D 7/0616 |
| EP | 2492653 | A1 | 8/2012 | |
| FR | 1141020 | A | 8/1957 | |
| FR | 2 370 558 | * | 6/1978 | B26D 7/32 |

* cited by examiner

SLICING MACHINE WITH REMOVABLE DEPOSITION PLATE

CROSS REFERENCE TO RELATED APPLICATIONS

This application claims benefit to German Patent Application No. DE 10 2014 113 505.9, filed Sep. 18, 2015, which is incorporated by reference herein.

FIELD

The invention relates to a slicing machine, and in particular, to a slicing machine for cutting off slices from lengths of food.

BACKGROUND

DE 88 07 446 U1 discloses a slicing machine having an integrated weighing apparatus. The weighing apparatus comprises a weighing plate arranged in the deposition region of the slicing machine. The weighing plate is designed to be removable, whereby the weighing plate has a support arm which points downwards and has a semi-circular opening which can be placed over a centering pin from above, which pin is arranged on the weighing cell. In practice, threading the weighing plate into the centering pin receptacle is relatively tricky and fiddly.

EP 0 216 754 B1 discloses a slicing machine for food products which likewise has a weighing device and a deposition tray arranged in the deposition region. The deposition tray can be inserted into a retainer of the weighing device from above.

SUMMARY

In an embodiment, a slicing machine for cutting slices from lengths of food is provided. The slicing machine includes a machine housing, which retains a drive motor and a rotating blade driven by the drive motor. The machine housing includes a deposition region which is arranged in the region of the blade and has a deposition plate for holding slices that have been cut off. The deposition plate has a rotary shaft and can be rotated from a horizontal position into a vertical position. The deposition plate is rigidly connected to the machine housing or to an attachment part of the machine housing when in the horizontal position, and the deposition plate is removable from the machine housing or from the attachment part of the machine housing when in a vertical position.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
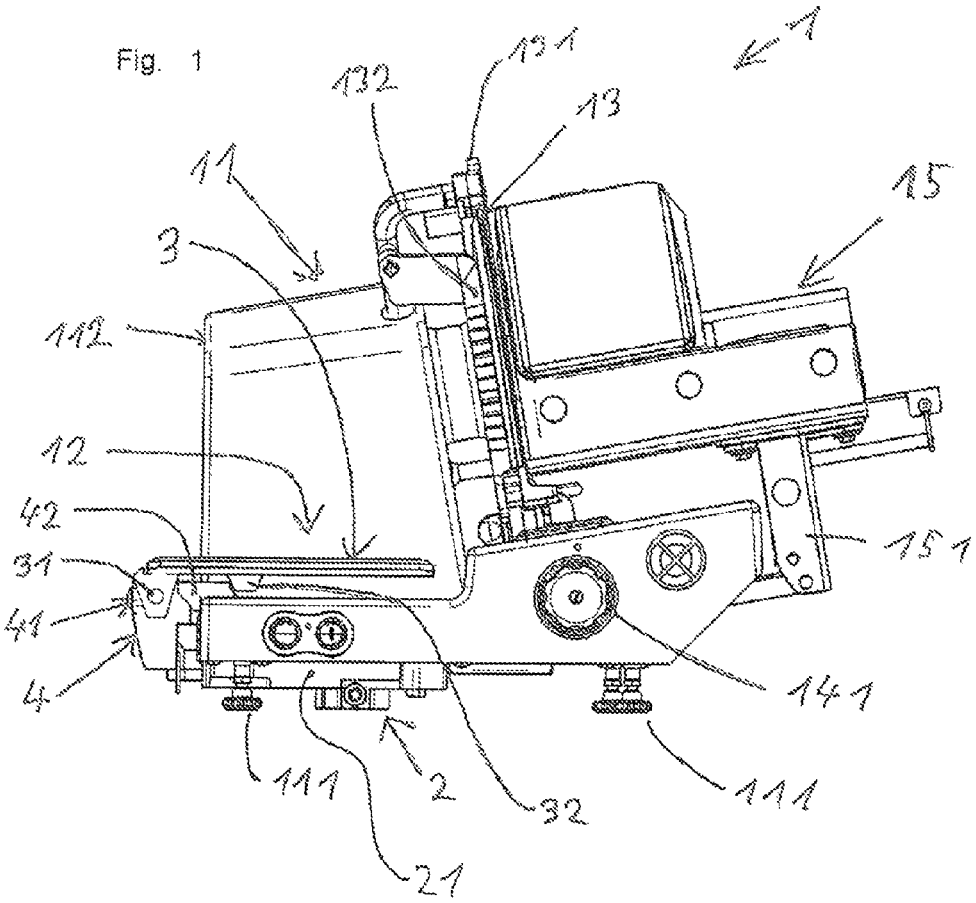
FIG. 1 depicts a view of a slicing machine according to an embodiment of the invention from the point of view of the operator.

An aspect of an embodiment of the invention is to provide a slicing machine for food products which is easy to clean and can be operated by a user in a simple and ergonomically advantageous manner.

In an embodiment, the invention provides a deposition plate that has a rotary shaft and can be rotated from a horizontal position into a vertical position, the deposition plate being rigidly connected to the machine housing or to an attachment part of the machine housing when in the horizontal position, and being removable from the machine housing or from an attachment part of the machine housing when in a vertical position.

The deposition plate is therefore mechanically and rigidly connected to the slicing machine when in its usage position, i.e. in the horizontal position. The deposition plate in particular has no play when in its usage position. To remove it, the deposition plate is pivoted or rotated upwards and then taken off. The deposition plate is inserted by correspondingly reversing this process, whereby it is oriented upwards, i.e. in the direction of the vertical, and connected to the machine housing or to an attachment part of the machine housing.

One advantage is that the coupling device is not visually obscured when the deposition plate is in a vertical position and is therefore clearly visible to an operator. An operator therefore does not have to blindly couple the deposition plate and the machine housing.

Subsequently rotating the deposition plate into the horizontal position rigidly connects it to the machine housing or to an attachment part of the machine housing. This results in particularly simple operation for a user since extensive threading work is dispensed with. In addition, the cleanability of the machine is increased since the process of removing the deposition plate and reattaching the deposition plate is made much simpler. As a result, the deposition plate can be removed for cleaning relatively quickly and then reconnected to the slicing machine after a slicing process. It is advantageous that no tools are required to remove or connect the deposition plate.

The deposition plate can be held in a stable manner by the machine housing or by an attachment part of the machine housing having a coupling device for releasably retaining the deposition plate.

The deposition plate can have a horizontally extending rotary shaft which, when the deposition plate is in a vertical position, can be inserted in a receptacle of the coupling device, thus providing ergonomically simple operation. The rotary shaft extending in a horizontal plane and preferably arranged in parallel with an edge or a lateral face of the slicing machine provides for particularly advantageous operation in terms of ergonomics, whereby the deposition plate can thus be rotated or pivoted in parallel with an edge of the slicing machine. In addition, the receptacle of the coupling device is designed to be freely accessible, in particular not countersunk or covered. The deposition plate or the rotary shaft thereof can thus be easily inserted into the receptacle.

In one embodiment, the deposition plate can comprise a bolt or a cone which rests against a contact surface of the coupling device or engages behind a contact surface of the coupling device when the deposition plate is in the horizontal position.

The deposition plate is held mechanically in a particularly stable manner by, in one configuration, the contact face being formed to be inclined with respect to the vertical. The contact surface interacts with the cone of the deposition plate in particular in such a way that the rotary shaft is secured in the receptacle, such that it cannot be removed therefrom, when the deposition plate is in the horizontal position.

In order to compensate for an installation surface for the slicing machine which is either oblique or not level, the height of the cone of the deposition plate and/or the contact surface of the coupling device can be adjusted in order to finely adjust the horizontal orientation of the deposition plate.

The height can be finely adjusted in a simple manner by the cone being mounted, by means of a thread, on the deposition plate such that its height can be adjusted.

Alternatively, the height of the cone can be finely adjusted by means of one or more washers which are optionally interposed between the cone and the deposition plate.

In an advantageous embodiment, the slicing machine can have a weighing device having a weighing cell and the coupling device can be connected to the weighing cell, preferably to the force-application side of the weighing cell.

It is possible for the slicing machine to have a modular design. The slicing machine can be designed as either a simple slicing machine having a removable deposition plate or as a slicing machine having an integrated weighing device. The cover plate or the receptacle for the cover plate can have the same design in both variants such that the slicing machine can be retrofitted or upgraded in a simple manner.

The deposition plate can preferably be designed as a load plate of the weighing device.

A particularly compact design can be achieved by, in one embodiment, the weighing cell being arranged inside the machine housing, the coupling device engaging through an opening in the machine housing.

In an alternative embodiment, the weighing cell can be housed in a separate housing, the separate housing being mechanically connectable to the machine housing. In particular, if the housing of the slicing machine does not have sufficient space to house a weighing device, said device can be housed in a separate housing. This separate housing is preferably closed so as to prevent the weighing device from becoming dirty. The separate housing is mechanically rigidly connected to the machine housing of the slicing machine by means of corresponding receptacles, in particular connected by means of a positive-locking or mechanical connection.

In one embodiment, the deposition plate and/or the load plate can be made of a metal, in particular aluminium or stainless steel, or of a plastics material.

It can also be provided that the deposition plate and/or the load plate can be exchanged, in particular that a deposition plate and/or load plate can be selected from a set of a plurality of deposition plates and/or load plates. Therefore, a defective or worn deposition plate or load plate can be easily exchanged for a new one without requiring complex servicing or maintenance. In addition, deposition plates or load plates having different designs can be provided which have, for example, different dimensions or are provided for different slicing materials and are connected to the slicing machine.

In order to also obtain an accurate weighing result when using different deposition plates or load plates, the weighing device can have a tare weight function for adaptation to a different weight of a new load plate.

The slicing machine according to an embodiment of the invention can in particular be used when selling fresh food products, for example when selling sausage or cheese products.

FIG. 1 is a front view of a slicing machine according to an embodiment of the invention, i.e. as it is seen by an operator who is standing in front of the machine and operating it. The slicing machine 1 comprises a machine housing 11 on which a rotating circular blade 13 and a slicing material carriage 15, which serves as a slicing material rest, are mounted. The blade 13 is driven by a motor (not shown) and rotates in a slicing plane which extends at a right angle to the slicing material rest. The motor for driving the blade 13 is housed in the machine housing 11 or in a motor tower 112 arranged thereon. The motor tower 112 extends upwards from a base face of the machine housing 11 and the inner space of said tower forms a space for housing the drive motor. The machine housing can be produced by means of a die-casting, permanent mould-casting or sand-casting method.

The slicing material carriage 15 can be moved back and forth in parallel with the slicing plane and is displaceably mounted in a carriage guide of the machine housing 11 by means of a carriage stand 151. The slicing material carriage 15 has a flat slicing material rest for preferably holding a length of slicing material. The slicing material is retained by means of a slicing material retainer (not shown). A contact prevention (not shown) aid is arranged in the front region of the slicing material carriage 15 and prevents a user from unintentionally touching the slicing region and therefore acts as an accident prevention aid.

A stop plate (not shown) is arranged in front of the blade 13 in parallel with the slicing plane and serves as a stop for the slicing material. The stop plate can be displaced in parallel with the slicing plane by means of a slicing thickness setting means 141 in order to set the thickness of the slices cut off. The slicing material on the slicing material carriage 15 rests against the stop plate during slicing and is fed to the blade 13 by means of the carriage 15 moving back and forth. The movement of the carriage causes individual slices to be cut from the slicing material, the thickness of which slices is determined by the slicing gap set by means of the stop plate.

A scraper 132 is arranged in the region behind the blade 13 and guides the slices which have been cut off away from the blade 13 and towards the deposition region 12. The knife of the circular blade 13 is covered by a blade guard ring 131 which encompasses the knife in a C-shape and forms a contact prevention aid for the blade. Together with the stop plate and the blade guard ring 131, most of the knife of the blade 13 is covered.

A deposition plate 3 is arranged in the deposition region 12. In FIG. 1, the deposition plate 3 is shown in its horizontal position. The slices which have been cut off are deposited on top of the deposition plate and can be removed therefrom altogether after the slicing material has been successfully cut. The deposition plate 3 is connected to a weighing device 2 by means of a coupling device 4. The coupling device 4 is connected to the load-application side of a weighing cell 21 which is housed inside the machine housing 11. The deposition plate 3 therefore simultaneously serves as a load plate of the weighing device 2. The coupling device 4 has a receptacle 41 and a contact surface 42.

Figure 2A:
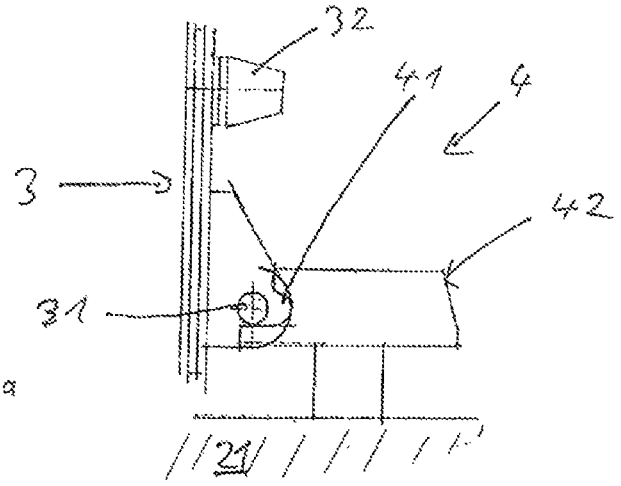
FIGS. 2*a* through 2*c* depict schematic views of a deposition plate according to an embodiment of the invention in positions having different inclinations.
Figure 2B:
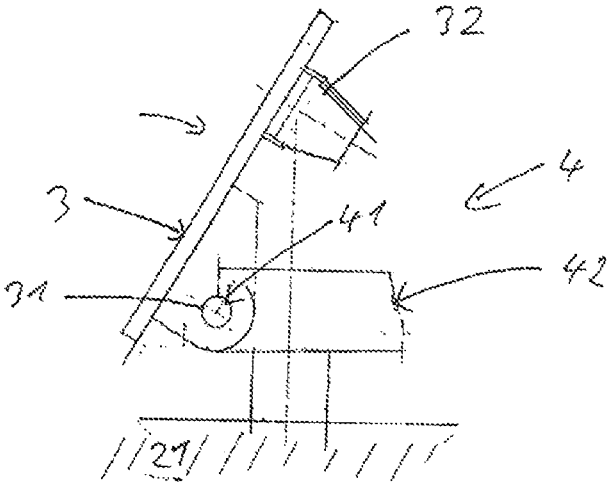
Figure 2C:
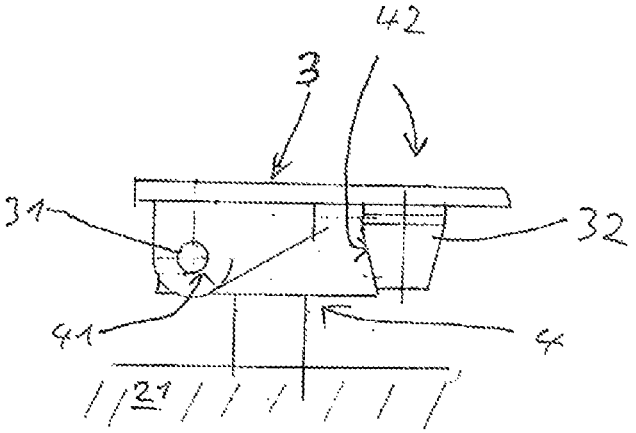

FIGS. 2*a* through 2*c* show how the deposition plate 3 can be connected to the coupling device 4 or how the deposition plate 3 can be removed from the coupling device 4. The coupling device 4 has the receptacle 41 having a round shape that is adapted to a rotary shaft 31 of the deposition plate 3. When in a vertical position, as shown in FIG. 2*a*, the deposition plate 3 can be easily inserted into the receptacle 41 by means of its rotary shaft 31 or can be removed from said receptacle 41.

Figure 3A:
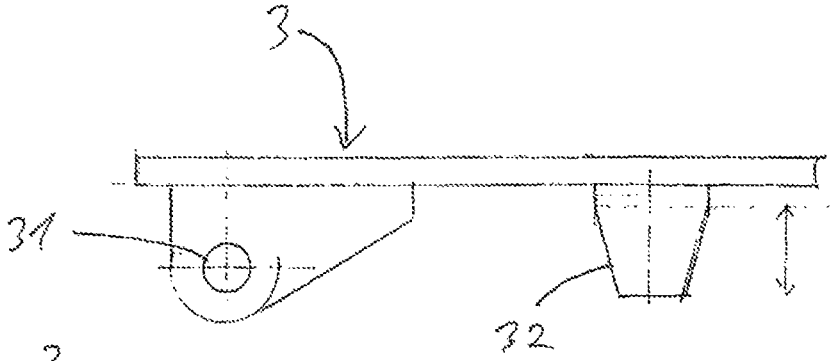
FIG. 3*a* depicts a schematic view of a deposition plate according to an embodiment of the invention.

The receptacle 41 of the coupling device 4 is not covered and is freely accessible from outside the machine housing 11 such that complex threading processes can be dispensed with. In addition, the receptacle 41 has a straight introduction face at its bottom end which serves as a fine-adjustment and introduction aid. Once the deposition plate 3 has been inserted into the coupling device 4, the deposition plate 3 is tilted in the direction of the horizontal, as shown in FIG. 2*b* by the arrow. Once the deposition plate 3 is in the horizontal position shown in FIG. 2*c*, a cone 32 arranged on the deposition plate 3 engages behind the contact surface 42 of the coupling device 4 and fixes the rotary shaft 31 of the deposition plate 3 in the receptacle 41 as a result. The deposition plate 3 is therefore rigidly connected to the coupling device 4 or to the machine housing 11 when in its horizontal position. The contact surface 42 is inclined with respect to the vertical. Its inclination corresponds to the oblique course of the external surface of the cone 32. The cone 32 therefore makes contact with the contact surface 42 without play and with an exact fit. As shown in FIG. 3*a*, the height of the cone 32 on the deposition plate 3 can be adjusted by means of a thread. As a result, the horizontal orientation of the deposition plate 3 can be finely adjusted.

Figure 3B:
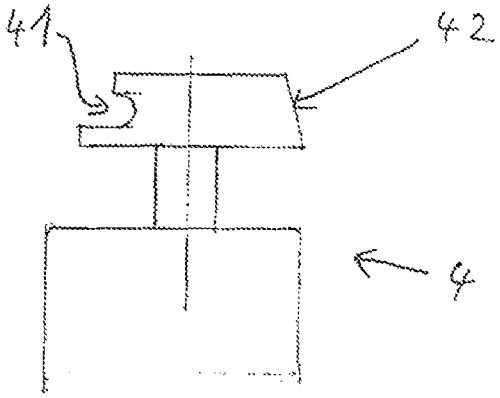
FIG. 3*b* depicts a schematic view of a coupling device according to an embodiment of the invention.

The coupling device 4 is shown in more detail in FIG. 3*b*. The coupling device 4 has the receptacle 41 and the contact surface 42, the contact surface comprising a running bevel 42 which is opposite said receptacle 41 and is formed so as to be tilted with respect to the vertical.

Figure 4:
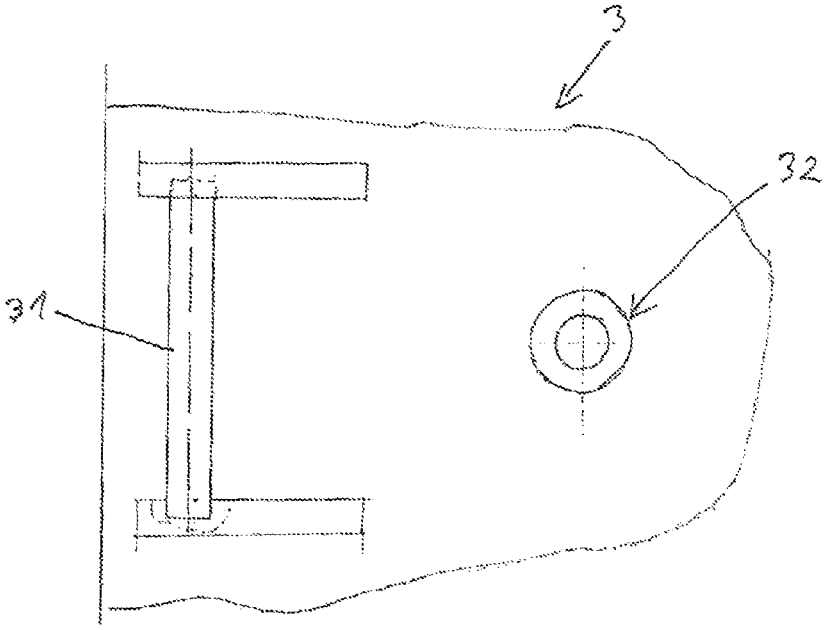
FIG. 4 depicts a schematic view underneath a deposition plate according to an embodiment of the invention.

The underside of the deposition plate 3 is shown in FIG. 4. The underneath of the deposition plate 3 comprises the rotary shaft 31 and the cone 32 which is arranged so as to be spaced apart from the rotary shaft 31. The deposition plate is formed as a flat plate which consists of either an aluminium alloy or stainless steel. The rotary shaft 31 arranged on the deposition plate 3 and the cone 32 can be made of either a plastics material or a metal.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

1 slicing machine
11 machine housing
111 housing feet
112 motor tower
12 deposition region
13 blade
131 blade guard ring
132 scraper
141 slice thickness setting means
15 carriage
151 carriage stand
2 weighing device
21 weighing cell
3 deposition plate
31 rotary shaft
32 cone
4 coupling device
41 receptacle
42 contact surface

What is claimed is:

1. A slicing machine for cutting slices from lengths of food, the slicing machine comprising:

a machine housing, which retains a drive motor and a rotating blade for cutting the slices, the rotating blade being driven by the drive motor, the machine housing including a deposition region which is arranged in the region of the blade, the deposition region comprising a deposition plate positioned for receiving and holding the slices that have been cut off, the deposition plate including a cone, wherein the deposition plate has a horizontally extending rotary shaft disposed in a receptacle of a coupling device such that the deposition plate can be rotated from a horizontal position into a vertical position, wherein the deposition plate is rigidly connected to the machine housing, by the coupling device, when in the horizontal position, wherein the deposition plate is removable from the machine housing when in the vertical position, wherein, when the deposition plate is in the vertical position, the horizontally extending rotary shaft is movable in a horizontal direction transverse to a longitudinal axis of the rotary shaft so as to be removable from and insertable into the receptacle of the coupling device whereby the coupling device is operable to releasably retain the deposition plate, and wherein, when the deposition plate is in the horizontal position, the cone rests against a contact surface of the coupling device opposite the receptacle limiting the movement of the rotary shaft in the horizontal transverse direction to provide the rigid connection.

2. The slicing machine according to claim 1, wherein the coupling device is disposed on the machine housing.

3. The slicing machine according to claim 1, wherein the contact surface is formed so as to be inclined with respect to a vertical direction and interacts with the cone of the deposition plate in such a way that the horizontally extending rotary shaft is secured in the receptacle such that it cannot be removed therefrom when the deposition plate is in the horizontal position.

4. The slicing machine according to claim 1, wherein at least one of a height of the cone of the deposition plate or a height of the contact surface of the coupling device can be adjusted in order to finely adjust the horizontal orientation of the deposition plate.

5. The slicing machine according to claim 4, wherein the cone is mounted on a portion of the deposition plate such that the height of the cone can be adjusted by a thread which may optionally be interposed between the cone and the portion of the deposition plate.

6. The slicing machine according to claim 1, further comprising a weighing device having a weighing cell, wherein the coupling device is connected to the weighing cell.

7. The slicing machine according to claim 6, wherein the deposition plate comprises a load plate of the weighing device.

8. The slicing machine according to claim 6, wherein the weighing cell is arranged inside the machine housing, and wherein the coupling device is engaged through an opening in the machine housing.

9. The slicing machine according to claim 6, wherein the coupling device is connected to a force application side of the weighing cell.

10. The slicing machine according to claim 1, wherein the deposition plate is made of at least one of aluminium, stainless steel, or a plastics material.

11. The slicing machine according to claim 10, wherein the deposition plate comprises a load plate of the weighing device.

12. The slicing machine according to claim 1, wherein the deposition plate is exchangeable.

13. The slicing machine according to claim 12, wherein the deposition plate comprises a load plate of the weighing device, and wherein the weighing device has a tare weight function for adaptation to a different weight of a new load plate.

14. The slicing machine according to claim 12, wherein the deposition plate comprises a load plate of the weighing device, and wherein at least the deposition plate can be selected from a plurality of deposition plates or the load plate can be selected from a plurality of load plates.

15. The slicing machine according to claim 1, wherein the cone which rests against the contact surface comprises a side of the cone which rests against the contact surface.

16. The slicing machine according to claim 1, wherein the horizontal position is approximately perpendicular to the vertical position.

* * * * *